United States Patent [19]

Gardella

[11] 3,973,597

[45] Aug. 10, 1976

[54] SELVEDGE-FORMING DEVICE IN SHUTTLELESS WEAVING LOOMS

[76] Inventor: Adriano Gardella, 24B, Via al Capo di S. Chiara, Genoa, Italy, I-16146

[22] Filed: Feb. 3, 1975

[21] Appl. No.: 546,617

[30] Foreign Application Priority Data

Feb. 14, 1974 Italy ..... 12476/74

[52] U.S. Cl. ..... 139/431

[51] Int. Cl.[2] ..... D03D 47/42

[58] Field of Search ..... 139/122 R, 124 R, 124 A

[56] References Cited

UNITED STATES PATENTS

| | | | |
|---|---|---|---|
| 3,682,205 | 8/1972 | Scott | 139/124 A |
| 3,752,195 | 8/1973 | Libby | 139/124 A |
| 3,811,479 | 5/1974 | Gardella | 139/124 A |

*Primary Examiner*—Henry S. Jaudon
*Attorney, Agent, or Firm*—Marvin Feldman

[57] ABSTRACT

A selvedge-forming device in shuttleless weaving looms, wherein two selvedge-forming needles are mounted for radial movement about a needle-carrying pivot arranged transversally to the warp threads and rotatably mounted in a selvedge-forming head that is slidably guided by the side of the warp threads, and is so reciprocated as to be driven forward, in the direction of the weft inserters path, and backwards, synchronously with the movement of the two weft inserters, means being provided positively controlled by the weft thread inserting needles which allow the selvedge needles to pivot back to their original position at the end of the forward run of the selvedge forming head.

3 Claims, 8 Drawing Figures

SELVEDGE-FORMING DEVICE IN SHUTTLELESS WEAVING LOOMS

BACKGROUND OF THE INVENTION

This invention relates to an apparatus for the formation of a stable and uniform selvedge on fabrics which are woven on shuttleless weaving looms. Selvedge forming apparatus of the kind to which this invention refers, are disclosed in my prior U.S. Pat. No. 3,811,479, filed June 12, 1972, having as title "Selvedge forming apparatus in shuttleless looms", to which reference is made for a more complete description of the mode of operation of the said apparatus. The apparatus according to this invention is described as used on a loom of the kind disclosed in my co-pending application Ser. No. 519,172 filed Oct. 30, 1974 and having as title "Method of weaving on shuttleless looms, and loom for performing said method".

In my U.S. Pat. No. 3,181,479 a selvedge-forming device for shuttleless weaving looms is disclosed, comprising a selvedge-forming needle fixedly mounted in a substantially radial position on a needle carrying pivot arranged transversally to the warp threads and rotatably mounted in a selvedge forming head that is slidably guided by the side of the warp threads, and is so reciprocated as to be driven forward, in the direction of the weft inserter path, and backwards, synchronously with the movement of the weft inserter itself. During the said movement of the selvedge forming head, the needle carrying pivot is caused to revolve in one direction so as to angularly lift up the selvedge forming needle in correspondence with a terminal fraction of the forward stroke of the selvedge forming head and turn in the opposite direction so as to angularly lower down the selvedge forming needle at the end of the forward run of the selvedge forming head. According to said my prior patent, the control of the rotational movement of the needle carrying pivot is obtained through a detent into engagement with a lever arm carried by the needle pivot, which detent is caused to be disengaged from said lever arm through a control derived from the rear end of the weft inserter by means of a movable abutment member and a transmission secured to the loom frame.

The above control arrangement was incumbrant, costly and the said transmission was easily damaged.

SUMMARY

This invention aims to obviate to the disadvantages of the prior art devices, by providing in a selvedge forming device for shuttleless weaving looms of the kind above described means positively operated through the weft thread inserting needle points, for disengaging the selvedge needle pivot lever arm from the said detent.

DESCRIPTION OF THE PREFERRED EMBODIMENT

Figure 5:
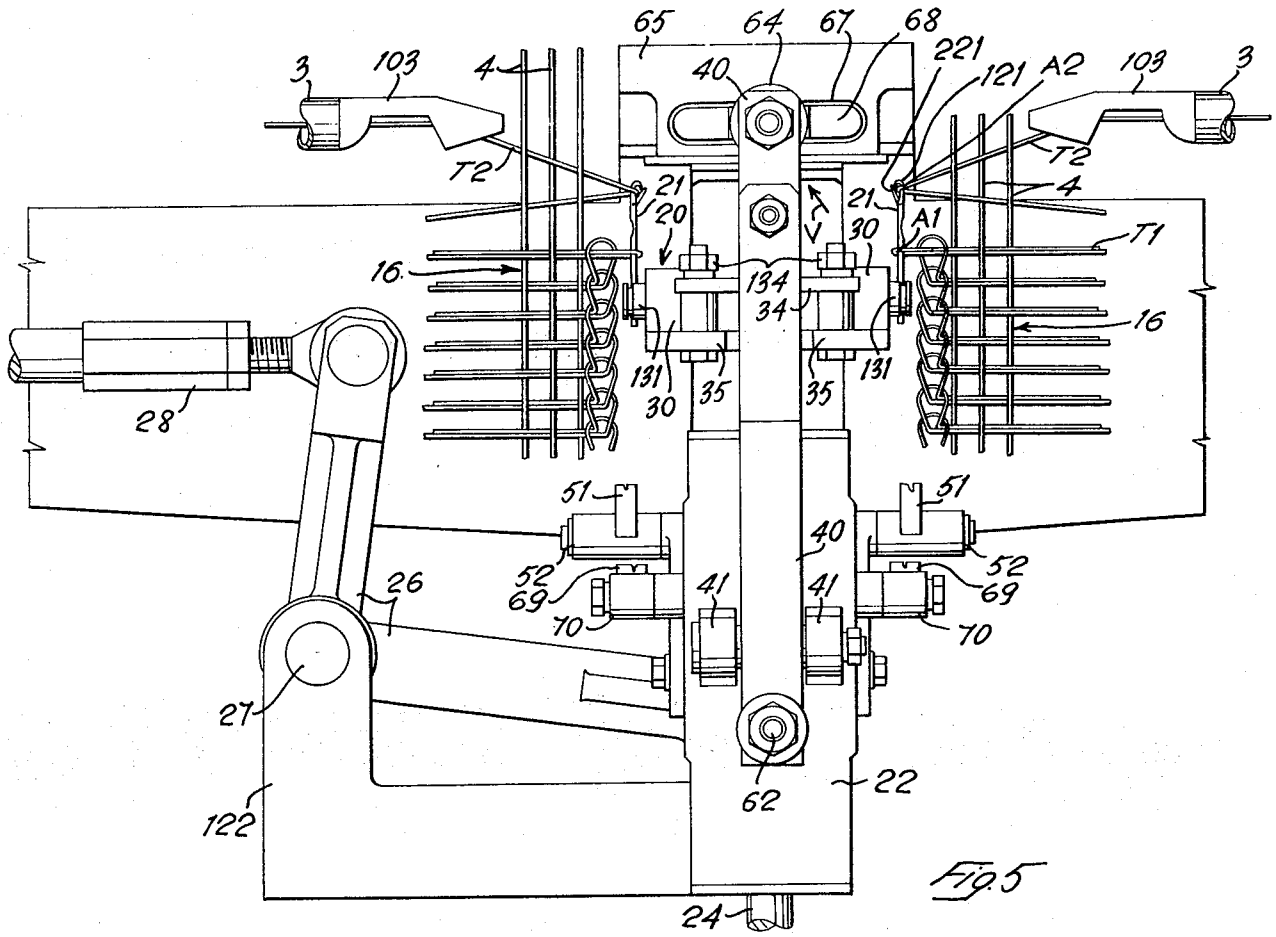
Figure 6:
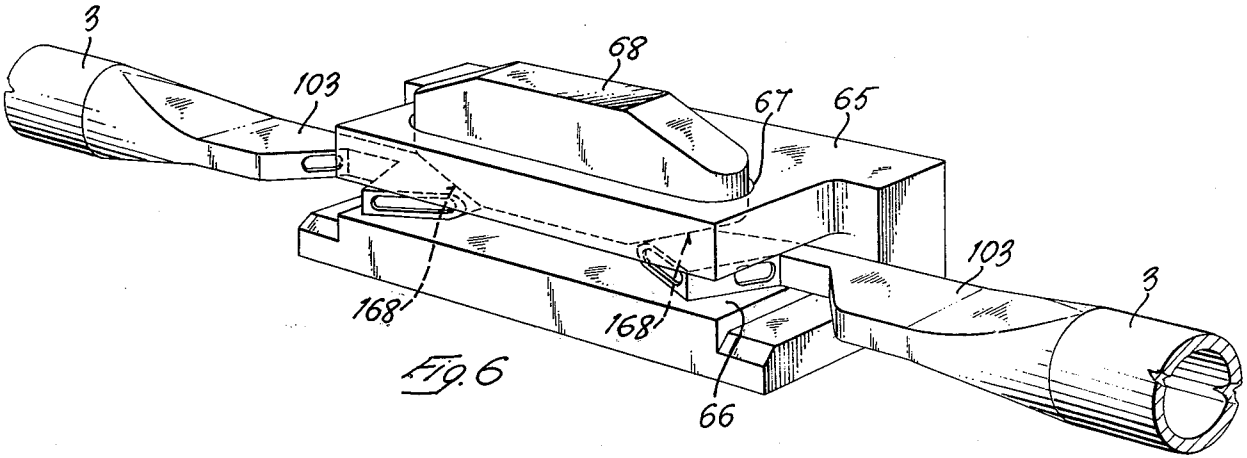

FIG. 5 is a plan view of the selvedge forming device;

FIG. 6 is a perspective view looking in the direction of arrow V of FIG. 5; and

Figure 8:
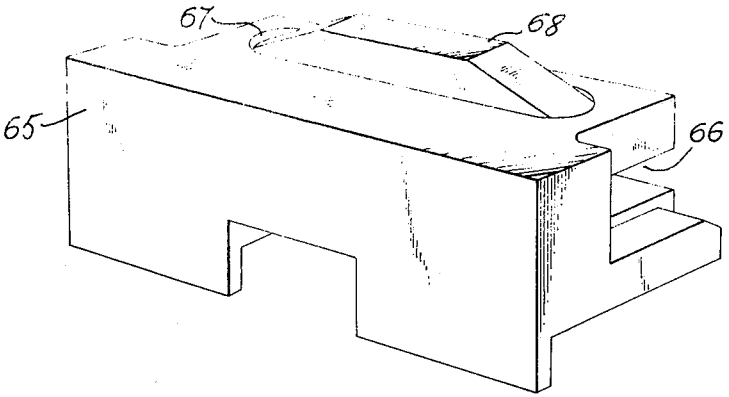
Figure 7:
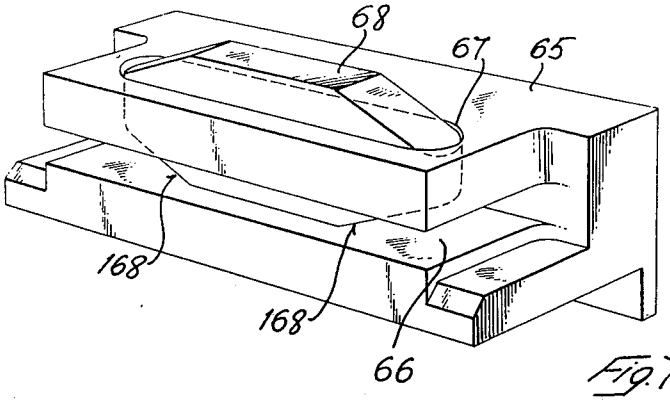

FIGS. 7 and 8 are perspective views of the device as shown in FIG. 6.

The shuttleless loom on which the selvedge forming device according to the invention is mounted, is of the kind disclosed in my patent application Ser. No. 519,172. This loom is provided with two weft thread inserting needles aligned the one respect to the other, located on opposite sides of the loom, and synchronously operated so as to effect simultaneously and concurrently their runs to and fro, each one over a length corresponding to one half of the width of the warp, so as to obtain two separate fabrics which are adjoining and coplanar. A selvedge forming device of the kind disclosed in my U.S. Pat. No. 3,811,479 is provided to operate between the two fabrics being formed so as to form two distinct selvedges on the inner adjoining edges of the fabric.

Referring to the drawings, the said selvedge-forming device is constituted by a horizontally disposed support 22 extending parallel to the warp threads 4, and fixedly mounted on the loom breast beam so as to be cantilevered therefrom. In the support 22 a horizontal rod 24 is mounted so as to be longitudinally slidable. On the end of said rod 24 which is turned towards the cloth-taking up beam there is fixedly mounted a sleeve 25 carrying on its underside a vertical point 125 to which an arm of a bell-crank lever 26 is pivotally attached. The said bell-crank lever 26 is fulcrumed at 27 to an extension 122 of the support 22, while its other arm is pivotally attached to a driving rod 28 which, in turn, is operated by any suitable part (not shown) of the weaving loom, so as to swing the bell-crank lever 26 and therefore so as to reciprocate to-and-fro the slidable rod 24, synchronously with the motion of the weft-inserting needle 3.

To the opposite end of rod 24, which is turned towards the path of the weft-inserting needle 3, a selvedge-forming head 20 is secured, which comprises a cross bar 29 carrying on its end parts two co-axial bushings 30 integrally formed therewith, whose horizontal axes are directed transversely to the warp threads 4. In these bushings 30 a shaft 31 is pivotably mounted, and on both ends 131 of said shaft which projects through the bushings 30 towards the cloth 16 the slevedge-forming needles 21 are secured which are constituted by knitting-machine needles. The selvedge-forming needles extend in the longitudinal direction of the warp threads 4 and projects forward towards the path of the weft-inserting needles 3.

Between the two bushings 30 of the selvedge-forming head 20, a flap or blade 32 extending upwardly and having a vertical slot 33 is fixedly mounted on the shaft 31. In front of said flap 32, that is, on its side turned towards the path of the weft-inserting needle 3, a transverse abutment member 34 is provided, which by means of two bolts 134 is secured to two sideways projecting members 35, which in turn are secured to the corresponding bushing 30. To said transverse abutment member 34 a substantially horizontal guide rod 36 is secured. This guide rod 36 projects rearwardly, and is passed through the slot 33 in flap 32. About the guide rod 36 is wound a helical pressure spring 37

'hich bears with one of its ends against a spring-bear-ıg bushing 38, secured to the free end of the rod 36, 'hile with its opposite end it bears against a spring-butment-bushing 39 which is slidably mounted on rod 6 and has a diameter greater than the width of the slot 3 in flap 32. This slidable spring-abutment-bushing 39 ; therefore urged by the spring 37 against the flap 32 ɔ as to swing forward the flap 32 in anti-clockwise irection, as viewed in FIG. 3, thus causing the said flap ɔ bear upon the transverse abutment member 34, as hown by full lines in FIG. 3. However the flap 32 can e rocked backwards, that is, in clockwise direction as iewed in FIG. 4, together with the shaft 31 and the ɜlvedge-forming needle 21, thus causing the spring-butment-bushing 39 to slide backwards on rod 36 and ɔading the spring 37.

On an upright part projecting from the upper side of ıe supporting member 22, a balance lever 40 is pro-ided which extends substantially parallel to the warp ıreads and is pivotally mounted at 41 on the said pro-ɜcting upright part of the supporting member 22, so as ɔ swing about said pivot 41 which is disposed trans-ersely to the warp threads. On the said lever 40, a stop ɔoth 42 is provided which engages the flap 32 in a ıanner that will be more fully described hereinafter.

Secured to the support member 22, a threaded stem 2 extends upwardly from said support up to a level bove the lever 40. A flat leaf spring 60 is secured by ne end to the upper end of the stem 62 by means of wo bolts 61. The said spring 60 extends substantially arallel to the lever 40, and is provided at its free end 'ith a head piece 63 abuting against the upper surface f lever 40.

To the free end of the lever 40 a downwardly project-ıg head member 64 is secured. Beneath the head ıember 64 a box 65 is secured to the extension 222 of he support 22. The said box 65 (FIGS. 7 and 8) is rovided with two opposed openings 66 coaxial one 'ith the other and with the weft inserting needles 3. 'he said openings 66 opens into a chamber 67 formed ı the box 65, and communicating with the exterior. nside of said chamber a sliding block 68 is freely dis-osed, extending with its upper end outwardly of box 5 into contact with the head 64 of lever 40. The said lock 68 is provided at its lower side with two opposed lanting sides 168, confronting the openings 66, and ooperating with the needle points 103 for the pur-oses which will be described later.

On both sides of the support 22, there are provided wo upright weft-holding wings or arms 51, extending arallel to the warp threads in a forward direction ɔward the path of the weft-inserting needles 3, and wingably pivoted on the shafts 52 extending sideways f the support 22 and transversely to the warp threads. 'he weft holding arm 51 has a lower edge 54 which is ıclined downwardly in the rearward direction and is rovided with a notch 53. The upward swinging of the ıid weft-holding arms 51 is limited by the abutment ıembers 69, which are adjustably secured at 70 to the ıpport 22.

The operation of the selvedge-forming device will be escribed hereinafter. Assume the starting position to e the one shown by full lines in the drawings, in which ıe rod 24, and the associated selvedge-forming head 0 together with the needle-carrying shaft 31, the sel-edge-forming needle 21, and also the flap 32, are fully 'ithdrawn away from the weft-inserting-needle 3, 'hile the stop tooth or detent 42 is in its lowermost position, in which it comes into engagement with the flap 32. The flap 32 projecting radially from the needle-carrying shaft 31 is in a substantially vertical position and is urged by the spring 37 against the transverse abutment member 34. The selvedge-forming needles 21, which are secured to the shaft 31, lies in a corre-sponding angular rest position slightly downwardly inclined relative to the plane of the fabric 16. The previously inserted double weft T1 is engaged in the notch 53 cut in the weft-holding arm 51 and forms a loop A1 about the selvedge forming needle 21, as shown in FIG. 5. The said loop A1 of the preceeding double weft thread T1 is engaged in the hook 121 of the selvedge forming needle 21, in the same manner as shown for the loop A2 formed from the next-coming double weft thread T2.

On inserting a new double weft thread T2, during the forward stroke of the weft-inserting-needles 3, the rod 24, together with the associated selvedge-forming head 20, the needle-carrying shaft 31, and the selvedge-forming needle 21, is shifted forwards in the direction of the path of said weft-inserting-needles 3. Since the previously inserted double weft T1 is engaged in the notch 53 of the weft holding arm 51, and is thus held thereby its loop A1 is slipped back on the shank of the selvedge forming needle 21, thus automatically open-ing the latch 221 of the needle 21.

Figure 1:
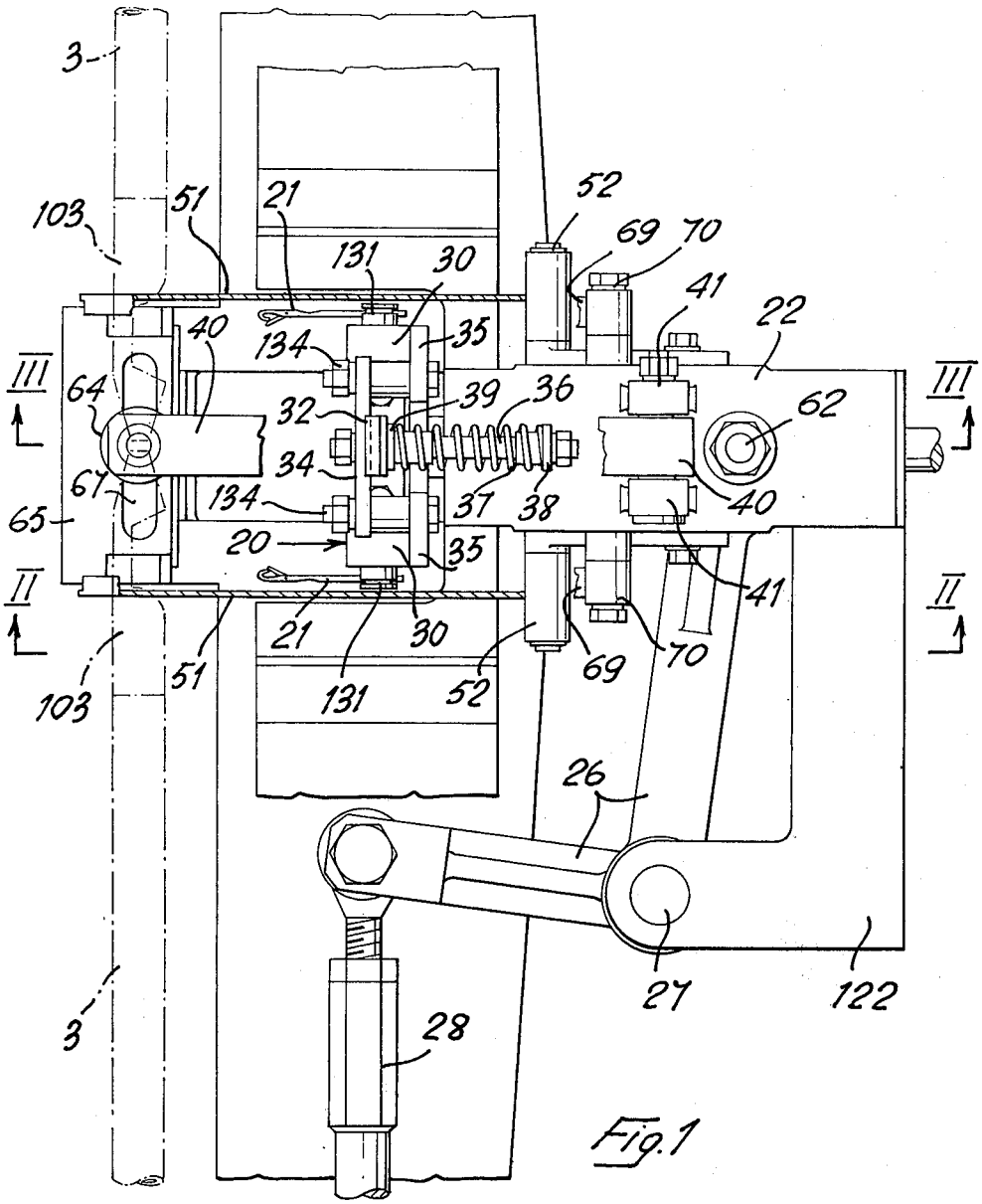
FIG. 1 is a top plan view of the device according to the invention, with parts sectioned and parts broken away.
Figure 2:
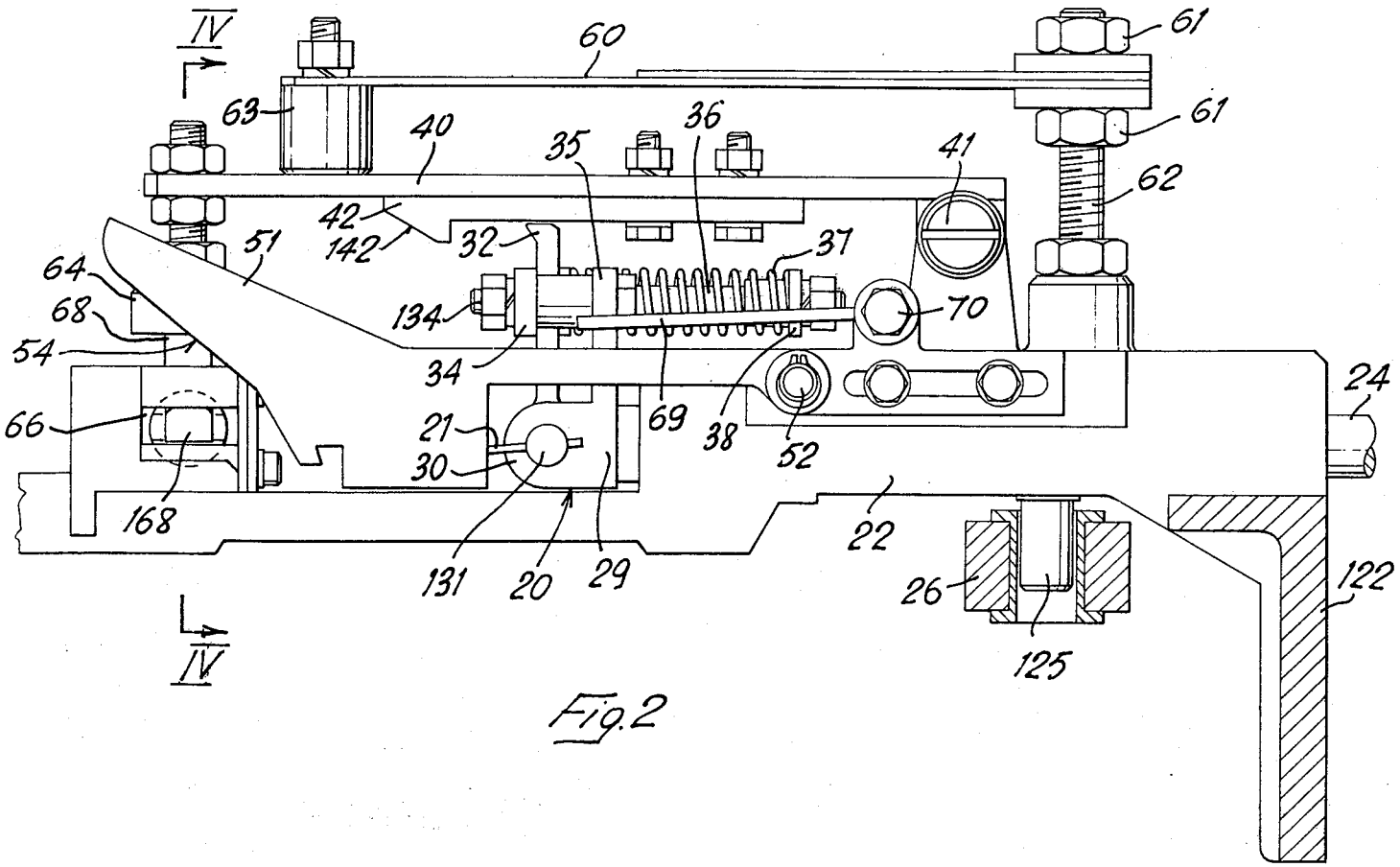
FIG. 2 is a side elevation view of the device according to the invention, taken along the line II—II of FIG. 1.
Figure 3:
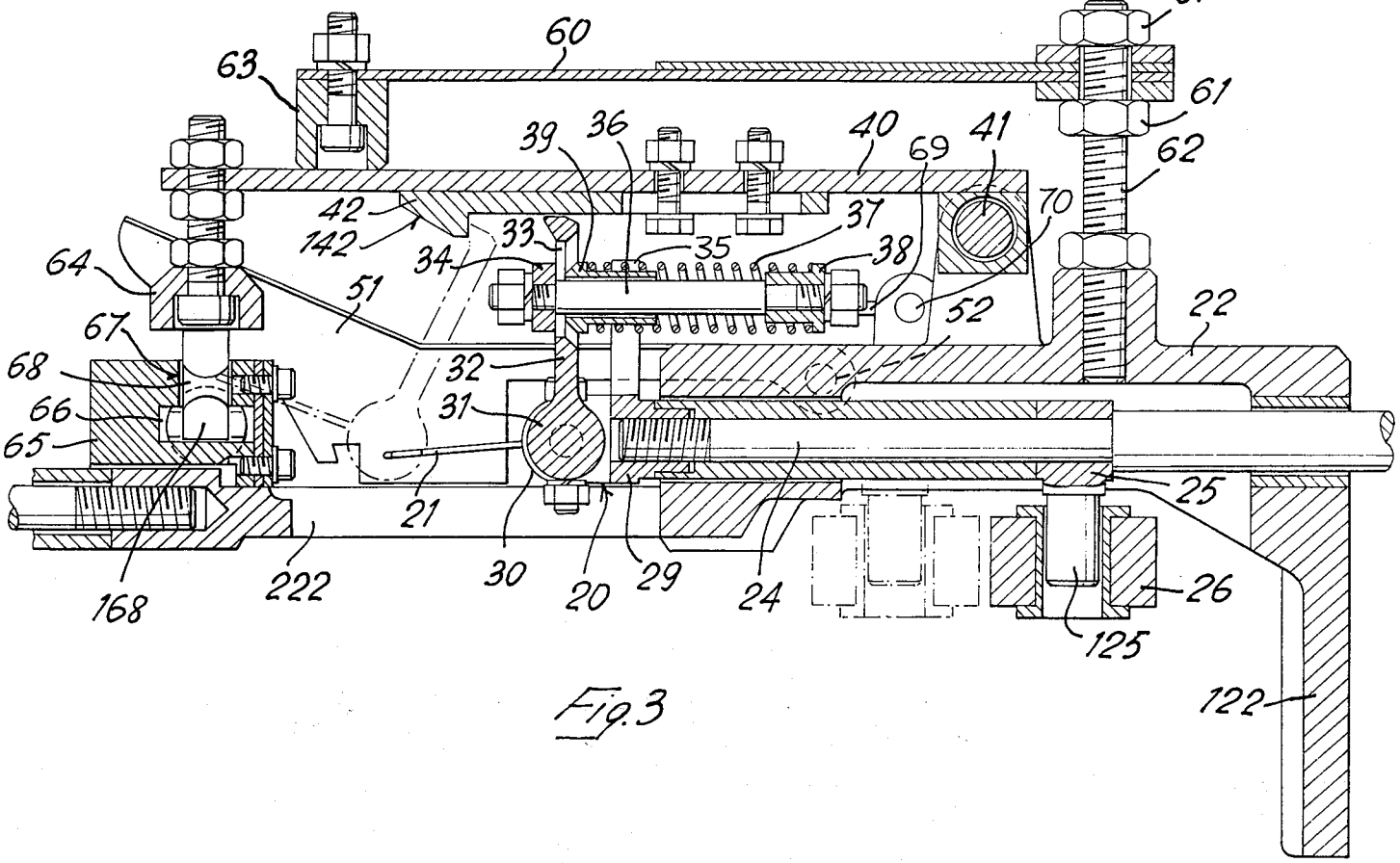
FIG. 3 is a longitudinal section of the device according to the invention, taken along line III—III of FIG. 1.
Figure 4:
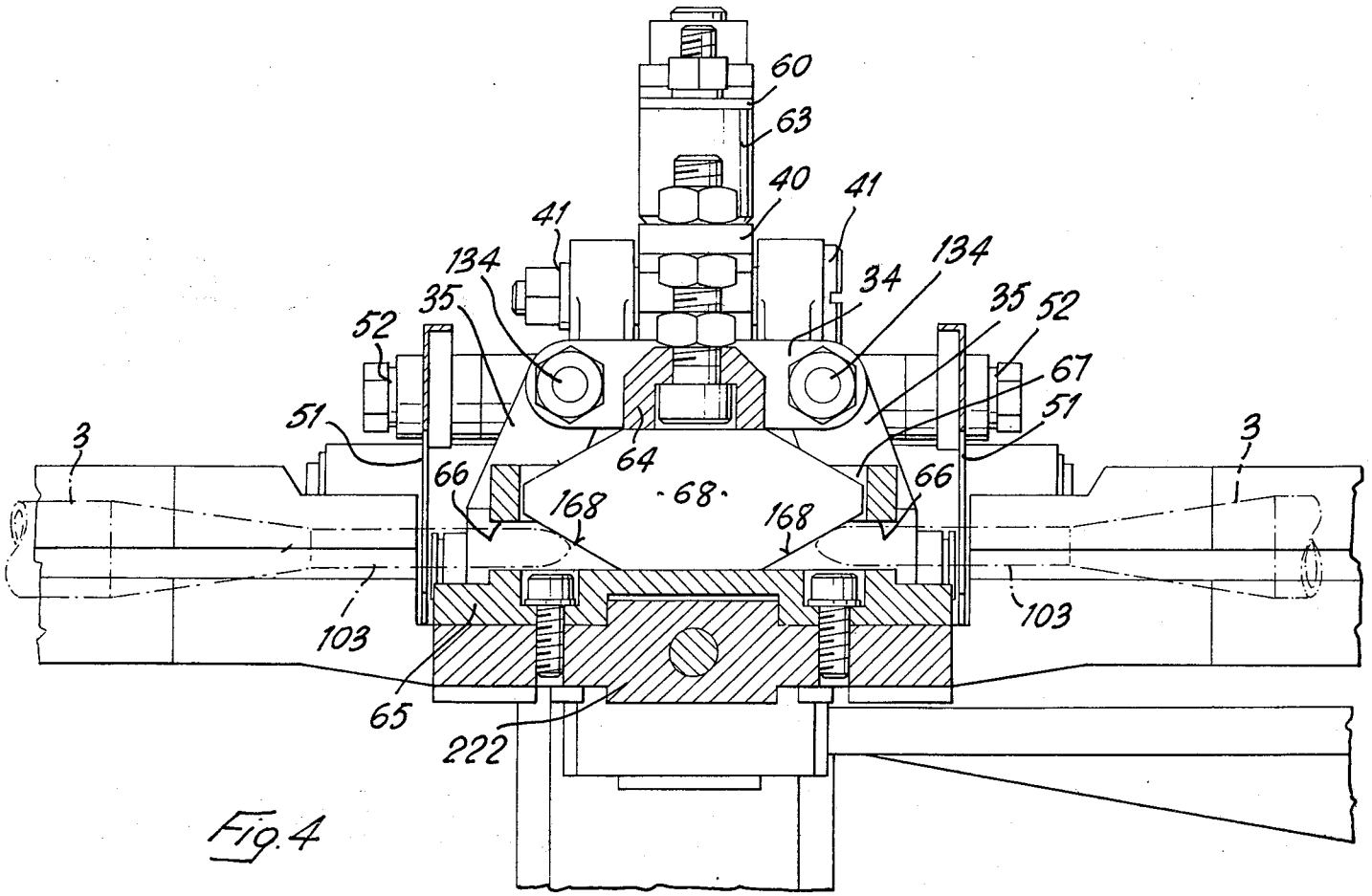
FIG. 4 is a transversal section of the device according to the invention taken along the line IV—IV of FIG. 1.

At about one-half of the forward stroke of the sel-vedge-forming head 20, the flap 32, supported by the needle-carrying shaft 31 abuts with its upper end against the detent 42 so that, while the forward run of the rod 24 and of the associated selvedge-forming head is being continued, the flap 32 is tilted backwards, against the action of spring 37, as shown by dot-and-dash lines in FIG. 3. The needle-carrying shaft 31 is thus revolved in bushings 30 by an angle corresponding to the said tilting of flap 32 which is integral with said shaft, so that the said shaft moves the selvedge-forming needle 21 from its lowered-down angular rest position to a lifted up angular position, which also shown by dash lines in FIG. 3. At the end of the forward stroke of the selvedge-forming head 20, the flap 32 is maintained by the arm 42 in its rearwardly tilted position, and therefore the selvedge-forming needle 21 is in its up-lifted angular position.

In the meantime, the weft-inserting-needles 3 have completed their forward stroke and have reached their end position in which the points 103 coact with the slanting sides 168 of the sliding block 68, lifting same together with the lever 40, thus lifting the stop tooth 42 in its flap releasing position, against the action of the spring 60. The flap 32, which is no longer held by the stop tooth or detent 42 is swung forwardly by the spring 37 up to the abutment cross piece 34, thus causing said flap to assume again its upright position. The needle-carrying shaft 31 is then revolved by a corresponding angle in bushings 30, in such a manner that the sel-vedge forming needles 21 are moved from their up-lifted angular position to their lowered-down reset posi-tion.

Subsequently, the rod 24 of the selvedge-forming device is driven backwards, to the right hand side of FIG. 3, together with the associated selvedge-forming head 20 supporting the needle-carrying pivot 31, the selvedge-forming needle 21, and also the flap 32, while the weft-inserting needles 3 are beginning their back-ward stroke by which they come out of the warp shed. Therefore, the points 103 of the needles 3 are retracted from the box 65 out of contact with the block 68, which is thus lowered in its rest position by the action of the spring 60. Also the lever 40 is returned to its starting position with the detent 42 down into its flap-engaging position. Therefore, during the backward stroke of the rod 24 and the associated selvedge-forming head 20, the flap 32 abuts against the detent 42, which is in its flap-engaging lowered-down position, but the said flap easily goes there-beyond, since by coming to slide upon the inclined detent fore edge 142, it will temporarily lift said detent upwards, thus merely causing the detent-carrying lever 40 to swing against the action of spring 60.

Of course the invention is not limited to the illustrated and described embodiment, but may be practiced by any other means making the selvedge by the same selvedge-forming method, while the afore-described selvedge-forming device may equally well be modified, particularly in construction, without departing from the leading principle as described above and as claimed hereinafter.

I claim:

1. A selvedge forming device for the formation of a selvedge in a shuttleless loom, comprising a warp shed a weft inserter, two selvedge forming needles and means for providing automatic operation of said needles in synchronism with the weft inserter, needles carrying shaft for fixedly mounting the selvedge forming needles in a substantially radial position, a selvedge forming head for rotatable mounting said needles carrying shaft, said selvedge forming head being slidably guided by the side of the warp threads and being so reciprocated as to be driven forward, in the direction of the path of movement of the weft inserter, and backwards synchronously with the movement of the weft inserter itself, means for rotating the needle-carrying shaft in one direction so as to angularly lift up the selvedge forming needle in correspondence with a terminal fraction of the forward stroke of the selvedge forming head and to turn the needle carrying shaft in the opposite direction, so as to angularly lower down the selvedge forming needles at the end of the forward run of the selvedge forming head, an arm formed integral with said needles carrying shaft, a return spring for maintaining said arm in an angular reset position corresponding to the lowered down position of the selvedge forming needles, a detent which cooperates with said return spring in such a manner that said arm is retained by the detent during the terminal fraction of the forward run of the selvedge forming head and is thus angularly shifted against the action of its respective return spring, whereby the needle carrying shaft is caused to be correspondingly turned, and the selvedge forming needles to be swung into the uplifted position thereof, and an abutment member disposed in the path of the weft inserting needles and provided with a slanting surface coacting with the point of the needles to lift the said abutment member whenever the needle point strikes against the said slanting surface of the abutment member, the said abutment member being connected to the said detent so as tc lift the said detent out of engagement with the said arm of the needle carrying shaft each time that the said abutment member is lifted by the said weft inserting needles.

2. A selvedge forming device according to claim 1, in which the said detent is secured to a lever arm, which is fulcrumed by one end and is into contact with its other end with the said liftable abutment member, spring means being provided for constantly urging said lever arm end into contact with said abutment member.

3. A selvedge forming device according to claim 1, in which the said abutment member is mounted into a support box, the said box being provided with a vertical opening in which the said abutment member is slidably supported and with at least one horizontal opening communicating with the bottom of said vertical opening for the passage of the weft inserting needle points.

* * * * *